US009879962B2

(12) United States Patent
Ueda

(10) Patent No.: US 9,879,962 B2
(45) Date of Patent: Jan. 30, 2018

(54) BLAST TREATMENT METHOD

(71) Applicant: Kobe Steel, Ltd., Hyogo (JP)

(72) Inventor: Masaya Ueda, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 15/303,664

(22) PCT Filed: Apr. 7, 2015

(86) PCT No.: PCT/JP2015/060810

§ 371 (c)(1),
(2) Date: Oct. 12, 2016

(87) PCT Pub. No.: WO2015/182252

PCT Pub. Date: Dec. 3, 2015

(65) Prior Publication Data

US 2017/0038185 A1 Feb. 9, 2017

(30) Foreign Application Priority Data

May 28, 2014 (JP) ..... 2014-110417

(51) Int. Cl.
*F42B 33/06* (2006.01)
*F42D 5/04* (2006.01)

(52) U.S. Cl.
CPC ..... *F42B 33/06* (2013.01); *F42D 5/04* (2013.01)

(58) Field of Classification Search
USPC ..... 86/50; 89/1.1
See application file for complete search history.

(56) References Cited

U.S. PATENT DOCUMENTS

| | | | | |
|---|---|---|---|---|
| 3,485,075 | A | 12/1969 | Kiselev et al. | |
| 5,574,203 | A | 11/1996 | Noel et al. | |
| 6,354,181 | B1 | 3/2002 | Donovan | |
| 8,661,960 | B2 * | 3/2014 | Ohlson | F23G 7/003 86/49 |
| 2007/0144637 | A1 | 6/2007 | Fujiwara et al. | |
| 2008/0282874 | A1 * | 11/2008 | Ogden | B65F 1/14 86/50 |

(Continued)

FOREIGN PATENT DOCUMENTS

| | | | |
|---|---|---|---|
| CN | 1118871 | A | 3/1996 |
| EP | 1 707 914 | A1 | 10/2006 |

(Continued)

OTHER PUBLICATIONS

International Search Report issued in PCT/JP2015/060810; dated Jul. 7, 2015.

(Continued)

*Primary Examiner* — John W Eldred
(74) *Attorney, Agent, or Firm* — Studebaker & Brackett PC

(57) ABSTRACT

A blast treatment method whereby a smoke grenade is blast treated inside an explosion-proof container, said method comprising: a blast step in which the smoke grenade (20) is exploded inside the explosion-proof container (10); and a dissolving step in which gas or micro particles generated when the smoke grenade (20) was exploded are dissolved inside the explosion-proof container (10), in a liquid (W) including a greater volume of water than the volume of water generated by the explosion of the smoke grenade (20).

7 Claims, 4 Drawing Sheets

(56) References Cited

U.S. PATENT DOCUMENTS

| | | | | |
|---|---|---|---|---|
| 2009/0229451 | A1 | 9/2009 | Asahina et al. | |
| 2012/0017750 | A1 * | 1/2012 | Koide | F42B 33/06<br>86/50 |

FOREIGN PATENT DOCUMENTS

| | | | |
|---|---|---|---|
| JP | H06-323794 | A | 11/1994 |
| JP | 3987871 | B1 | 10/2007 |
| WO | 96/00880 | A1 | 1/1996 |

OTHER PUBLICATIONS

Written Opinion issued in PCT/JP2015/060810; dated Jul. 7, 2015.
The extended European search report issued by the European Patent Office dated Sep. 14, 2017, which corresponds to EP15799248.8-1655 and is related to U.S. Appl. No. 15/303,664.

* cited by examiner

FIG. 3

| | ITEMS | UNIT | WP-1 OXYGEN +WATER | WP-2 OXYGEN + WATER + NEUTRALIZER | WP-3 OXYGEN +WATER | WP-4 OXYGEN + WATER + NEUTRALIZER | RP-1 OXYGEN +WATER | RP-2 OXYGEN + WATER + NEUTRALIZER |
|---|---|---|---|---|---|---|---|---|
| CONDITIONS BEFORE BLAST | SIZE OF BLAST CONTAINER | L | 5 | 5 | 20 | 20 | 5 | 5 |
| | KIND OF EXPLOSIVE | | PETN | PETN | PETN | PETN | PETN | PETN |
| | AMOUNT OF EXPLOSIVE | g | 4 | 4 | 16 | 16 | 4 | 4 |
| | KIND OF REAGENT | | WHITE PHOSPHORUS | WHITE PHOSPHORUS | WHITE PHOSPHORUS | WHITE PHOSPHORUS | RED PHOSPHORUS | RED PHOSPHORUS |
| | P | g | 3.11 | 3.30 | 11.07 | 11.07 | 2.50 | 2.50 |
| | $Na_2CO_3$(NEUTRALIZER) | g | | 5 | | 17 | | 5 |
| | AMOUNT OF OXYGEN SUPPLIED | NL | 3.19 | 3.28 | 12.45 | 12.80 | 3.10 | 3.12 |
| | AMOUNT OF WATER SUPPLIED | g | 1.4 | 29.9 | 5.78 | 120.78 | 0 | 30 |
| LIQUID RECOVERED FROM INSIDE PRESSURE-RESISTANT CONTAINER | TOTAL AMOUNT OF PHOSPHORUS IN PHOSPHORUS OXIDE | g | 2.85 | 2.49 | 10.83 | 9.98 | 2.01 | 1.87 |
| | T-P | g | 3.00 | 2.90 | 11.00 | 10.00 | 2.10 | 2.20 |
| | UNREACTED PHOSPHORUS | g | 0.15 | 0.41 | 0.17 | 0.02 | 0.09 | 0.33 |
| | T-Na | g | | 1.90 | | 6.60 | | 1.90 |
| | T-$CO_3$ | g | | 0.02 | | 0.03 | | 0.58 |
| | RECOVERY RATE OF PHOSPHORUS | % | 96.3% | 87.9% | 99.3% | 90.3% | 84.0% | 88.0% |
| | REMAINING RATE OF UNREACTED PHOSPHORUS IN RECOVERED LIQUID | % | 5.1% | 14.0% | 1.5% | 0.2% | 4.1% | 15.0% |
| | RECOVERY RATE OF SODIUM | % | | 87.6% | | 89.5% | | 87.6% |
| | RECOVERY RATE OF CARBONATE IONS | % | | 0.7% | | 0.3% | | 20.5% |
| | AMOUNT OF WATER SUPPLIED TO PRESSURE-RESISTANT CONTAINER AFTER GAS RECOVERY | g | 1,000 | 1,000 | 1,000 | 1,000 | 1,000 | 1,000 |
| | pH OF RECOVERED LIQUID | pH | 2.0 | 3.4 | 1.0 | 3.6 | 2.0 | 6.6 |
| COMPONENTS MOVED TO DETONATION PRODUCT GAS | $PO_4^{3-}$(MOVED TO GAS) | | 0.0030 | 0.0005 | 0.0020 | 0.0001 | <0.0001 | 0.0009 |
| | T-P(MOVED TO GAS) | | 0.001 | 0.0002 | 0.0007 | 0.00003 | <0.00003 | 0.0003 |
| COMPONENTS OF GAS IN PRESSURE-RESISTANT CONTAINER AFTER AIR SUPPLY | $PO_4^{3-}$(DEEMED OXIDIZED) | | 0.0006 | 0.0004 | 0.0005 | 0.0001 | <0.0001 | <0.0001 |
| | T-P(SEE DIFFERENCE FROM ABOVE) | | 0.0002 | 0.0001 | 0.0002 | 0.00003 | <0.00003 | <0.00003 |

FIG. 4

| | ITEMS | UNIT | HC-1 OXYGEN +WATER | HC-2 OXYGEN + WATER + NEUTRALIZER | HC-3 OXYGEN +WATER | HC-4 OXYGEN + WATER + NEUTRALIZER |
|---|---|---|---|---|---|---|
| CONDITIONS BEFORE BLAST | SIZE OF BLAST CONTAINER | L | 5 | 5 | 20 | 20 |
| | KIND OF EXPLOSIVE | | PETN | PETN | PETN | PETN |
| | AMOUNT OF EXPLOSIVE | g | 4 | 4 | 16 | 16 |
| | KIND OF REAGENT | | HC | HC | HC | HC |
| | $C_2Cl_6$ | g | 1.90 | 1.90 | 7.60 | 7.60 |
| | ZnO | g | 1.80 | 1.80 | 7.20 | 7.20 |
| | Al | g | 0.30 | 0.30 | 1.20 | 1.20 |
| | $Na_2CO_3$ (NEUTRALIZER) | g | | 2.50 | | 10.00 |
| | AMOUNT OF OXYGEN SUPPLIED | NL | 3.11 | 3.13 | 11.89 | 4.71 |
| | AMOUNT OF WATER SUPPLIED | g | 0 | 0 | 0 | 120 |
| | C | g | 0.19 | 0.19 | 0.77 | 0.77 |
| | Cl | g | 1.71 | 1.71 | 6.83 | 6.83 |
| | Zn | g | 1.45 | 1.45 | 5.78 | 5.78 |
| | Na | g | | 1.08 | | 4.34 |
| | $CO_3$ | g | | 1.42 | | 5.66 |
| LIQUID RECOVERED FROM INSIDE PRESSURE-RESISTANT CONTAINER | T-Zn | g | 1.30 | 0.76 | 5.40 | 4.50 |
| | T-Cl | g | 1.70 | 1.20 | 6.90 | 5.60 |
| | T-Na | g | | 0.96 | | 4.10 |
| | T-$CO_3$ | g | | 0.01 | | 0.02 |
| | RECOVERY RATE OF ZINC | % | 89.9% | 52.6% | 93.3% | 77.8% |
| | RECOVERY RATE OF CHLORINE | % | 99.6% | 70.3% | 101.0% | 82.0% |
| | RECOVERY RATE OF SODIUM | % | | 88.5% | | 94.5% |
| | RECOVERY RATE OF CARBONATE IONS | % | | 29.6% | | 22.6% |
| | AMOUNT OF WATER SUPPLIED TO PRESSURE-RESISTANT CONTAINER AFTER GAS RECOVERY | g | 1,000 | 1,000 | 1,000 | 1,000 |
| | pH OF RECOVERED LIQUID | pH | 5.4 | 7.6 | 5.4 | 7.4 |
| COMPONENTS MOVED TO DETONATION PRODUCT GAS | T-Zn | | <0.01 | <0.01 | <0.01 | <0.01 |
| | T-Cl | | <0.01 | <0.01 | <0.01 | <0.01 |
| COMPONENTS OF GAS IN PRESSURE-RESISTANT CONTAINER AFTER AIR SUPPLY | T-Zn | | <0.01 | <0.01 | <0.01 | <0.01 |
| | T-Cl | | <0.01 | <0.01 | <0.01 | <0.01 |

BLAST TREATMENT METHOD

TECHNICAL FIELD

The present invention relates to a method of blast treatment of a smoke projectile which emits smoke at the time of a blast.

BACKGROUND ART

Conventionally, blast treatment methods in which an explosive object such as a chemical ammunition is subjected to blast treatment in a blast-proof container are known. For example, Patent Document 1 discloses a blast treatment method which places the explosive object in a pressure-resistant container having a closable lid, and carries out explosion of the explosive object in the pressure-resistant container which has been turned into a sealed space by the closure of the lid, to thereby decompose a chemical agent contained in the explosive object. Patent Document 1 also describes withdrawing of a gas produced at the time of the explosion of the explosive object with a suction device which is provided outside the pressure-resistant container.

In addition to chemical ammunition s and the like, it is also desired in recent years to dispose of smoke ammunition that emit smoke when blasted (hexachloroethane smoke projectiles, white phosphorus smoke projectiles, red phosphorus smoke projectiles and the like). When such a smoke ammunition is subjected to blast treatment in a pressure-resistant container as set forth in Patent Document 1, a toxic gas and fine particles may be produced in a large amount in the pressure-resistant container in some cases. As a result, there are a concern of an increased load on the suction device for drawing out the gas and fine particles that exist in the pressure-resistant container after the blast treatment of the smoke ammunition, and a concern of leakage of the toxic gas and fine particles, which remain in the pressure-resistant container, to the outside.

CITATION LIST

Patent Document

Patent Document 1: JP 3987871 B

SUMMARY OF THE INVENTION

An object of the present invention is to provide a blast treatment method which is capable of reducing the amount of a toxic gas and fine particles in a blast-proof container after blast treatment of smoke ammunition.

A blast treatment method according to one aspect of the present invention is a blast treatment method in which smoke ammunition which emits smoke at the time of a blast is subjected to blast treatment in a blast-proof container. The method comprises a blast step to blast the smoke ammunition in the blast-proof container, and a dissolution step to dissolve, in the blast-proof container, a toxic gas and fine particles, which are produced when the smoke ammunition is blasted, into a liquid that contains water in an amount larger than an amount of water produced due to the blast of the smoke ammunition.

BRIEF DESCRIPTION OF DRAWINGS

FIG. 3 is a table showing results of measurement obtained when white phosphorus smoke projectiles and red phosphorus smoke projectiles were, respectively, subjected to blast treatment on a small scale.

FIG. 4 is a table showing results of measurement obtained when hexachloroethane smoke projectiles were subjected to blast treatment on a small scale.

DESCRIPTION OF EMBODIMENTS

First Embodiment

A method of blast treatment of smoke projectiles 20 of the first embodiment of the present invention will be described with reference to FIG. 1.

Figure 1:
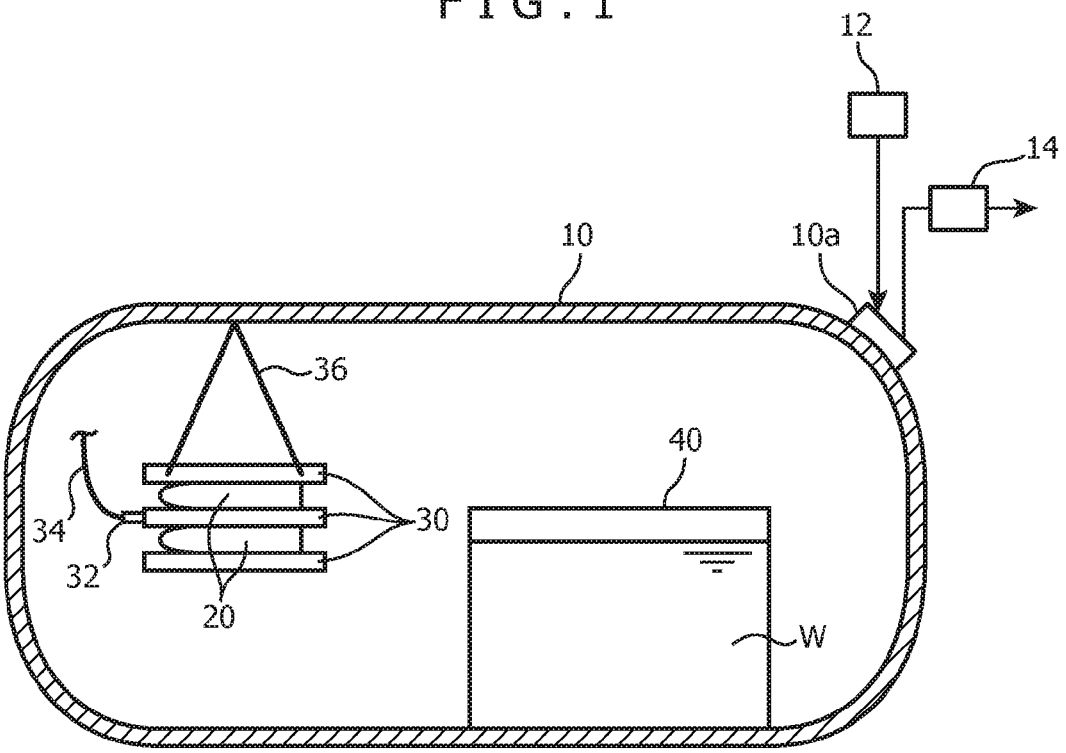
FIG. 1 is a schematic diagram of a blast treatment apparatus for carrying out a blast treatment method according to a first embodiment of the present invention.

The blast treatment method of this embodiment is carried out by using the blast treatment apparatus shown in FIG. 1. The blast treatment apparatus is provided with a blast-proof container 10, a supplying device 12 and a suction device 14.

The blast-proof container 10 is configured to have strength to withstand an impact load at the time of blasting of the smoke projectiles 20. In this embodiment, white phosphorus smoke projectiles (WP smoke projectiles) or red phosphorus smoke projectiles (RP smoke projectiles) are subjected to blast treatment as the smoke projectiles 20. The smoke projectiles 20 each comprise a shell and a burster (white phosphorus or red phosphorus) contained in the shell.

Around the smoke projectiles 20, explosives 30 are disposed. The explosives 30 are blasted by ignition of a detonator 32 through a detonating cord 34. In this embodiment, the explosives 30 are placed in a state of being hung with hanging members 36 such as strings in the blast-proof container 10.

The supplying device 12 is a device for supplying oxygen or an oxygen-containing gas (air, or the like) into the blast-proof container 10 through an opening 10*a* provided in the blast-proof container 10.

The suction device 14 is a device for drawing gas and fine particles out from the blast-proof container 10 through the opening 10*a*. The suction device 14 comprises a sucking pump and a filter provided in the upstream side of the sucking pump.

In the next place, a method for carrying out blast treatment of the smoke projectiles 20 will be described.

Firstly, the smoke projectiles 20 and the explosives 30 are hung from an upper wall of the blast-proof container 10 with the hanging members 36.

Then, a liquid (aqueous solution) W comprising water and an alkaline agent (neutralizer) is placed in the blast-proof container 10. In this embodiment, sodium carbonate is used as the agent. Alternatively, calcium carbonate or calcium oxide may be used as the agent. The liquid W is placed at a position spaced apart from the smoke projectiles 20 within the blast-proof container 10. The liquid W is held in a container 40 (a bag or the like) which has strength that allows the bag to be destroyed by a detonation which occurs upon explosion of the explosives 30. The amount of the water contained in the liquid W held in the container 40 is set at an amount capable of precipitating whole white smoke occurred at the time of blasting of the white phosphorus smoke projectiles or red phosphorus smoke projectiles. Specifically, eight or more molecules of the water are required per molecule of phosphoric acid. When a 155 mm white phosphorus smoke projectile is subjected to blast treatment, for example, the amount of white phosphorus contained in the smoke projectile is 7.1 kg, and accordingly, the amount of water is set at 33 L or more. The amount of sodium carbonate required to convert phosphoric acid, which is produced at the time of blast treatment of the white phosphorus smoke projectile, into sodium phosphate is 36.4 kg. The liquid W may consist of water alone, rather than an aqueous alkaline solution containing the agent.

Subsequently, gas in the blast-proof container 10 is drawn out by the suction device 14. Thereafter, oxygen is supplied into the blast-proof container 10 with the supplying device 12. The supply amount of the oxygen is set at such an amount as being capable of oxidizing the whole phosphorus contained in the white phosphorus smoke projectiles or red phosphorus smoke projectiles. When a 155 mm white phosphorus smoke projectile is subjected to blast treatment, the supply amount of oxygen is set at 9.2 kg (0.29 kmol or 6.41 $Nm^3$) or more.

Thereafter, the detonator 32 is ignited through the detonating cord 34 to blast the explosives 30. A detonation occurred at this time destroys the shells of the smoke projectiles 20 and micronizes the burster (white phosphorus or red phosphorus). The micronized burster is converted into phosphorus oxide ($P_2O_5$) through a reaction with oxygen which exists in the blast-proof container 10, as shown by the following Formula (1).

$$4P+5O_2 \rightarrow 2P_2O_5+\text{heat} \quad (1)$$

This phosphorus oxide disperses in the form of fine particles in the blast-proof container 10.

Further, the detonation destroys the container 40, and at the same time, the water contained in the liquid W vaporizes, and water vapor which comprises the agent (neutralizer) is disperses in the blast-proof container 10. As a result, as shown by Formula (2) below, the fine particles of the phosphorus oxide are converted into phosphoric acid ($H_3PO_4$) through a reaction with the water vapor.

$$P_2O_5+3H_2O \rightarrow 2H_3PO_4 \quad (2)$$

This phosphoric acid further reacts with the water (water vapor) to produce white smoke. The water vapor condenses as the temperature inside the blast-proof container 10 lowers after the detonation. Upon this condensation, the white smoke is dissolved into (captured by) the water produced through the condensation of the water vapor. Then, the liquid with the white smoke captured therein accumulates on the bottom of the blast-proof container 10. In other words, the fine particles of the phosphorus oxide produced at the time of the blast of the white phosphorus smoke projectiles or red phosphorus smoke projectiles are allowed to settle in the water.

Then, the detonation product gas which exists in the blast-proof container 10 (nitrogen, hydrogen, carbon monoxide, and so on) is drawn out by the suction device 14. Subsequently, air is supplied into the blast-proof container 10 by the supplying device 12, and after that, the liquid W is recovered from the inside of the blast-proof container 10.

As described above, in the blast treatment method of this embodiment, the fine particles of toxic phosphorus oxide produced at the time of the blast of the white phosphorus smoke projectiles or red phosphorus smoke projectiles are dissolved into (allowed to settle in the water) the liquid W, which contains water in an amount larger than an amount of water produced due to the blast of the smoke projectiles, in the blast-proof container 10. Thus, the load on the suction device 14, which draws the gas (detonation product gas) and fine particles out from the inside of the blast-proof container 10 after the blast, is reduced. In addition, the fine particles are inhibited from leaking outside when the inside of the blast-proof container 10 is opened to the outside of the blast-proof container 10 after the blast treatment.

Since this embodiment supplies blast-proof container 10 with liquid W in an amount capable of dissolving the fine particles of phosphorus oxide in their entirety, it is also possible to recover the fine particles substantially in their entirety along with the liquid W in the blast-proof container 10.

In addition, in this embodiment, the liquid W is placed in blast-proof container 10 prior to the blast of the smoke projectiles 20, and thereafter, the smoke projectiles 20 are blasted. In this manner, the blast-proof container is filled with water vapor produced through the evaporation of water from the liquid W due to a detonation occurred at the time of the blast. After the detonation, the water vapor then condenses as the temperature lowers. Into the water occurred through the condensation of the water vapor, the gas and fine particles are dissolved (captured). Incidentally, in addition to the water in the liquid W, water derived from explosives 30 and water produced through the detonation are also effective for the capture of the gas and fine particles. Thus, the efficiency of recovery of the fine particles is improved as compared with a case where the fine particles are dissolved into the liquid W in the blast-proof container 10 by supplying the liquid W into the blast-proof container 10 after blasting the smoke projectiles 20.

Besides, in the present embodiment, the blast of the white phosphorus smoke projectiles or red phosphorus smoke projectiles is carried out in such a state that oxygen in an amount capable of oxidizing the whole amount of phosphorus contained in the smoke projectiles exists in blast-proof container 10. Therefore, the phosphorus contained in the smoke projectiles is effectively oxidized (disposed of) as the white phosphorus smoke projectiles or red phosphorus smoke projectiles are blasted. Specifically, the phosphorus contained in the white phosphorus smoke projectiles or red phosphorus smoke projectiles is micronized at the time of the blast, resulting in the provision of an increased surface area to the phosphorus, and resulting in an increased probability of collisions between phosphorus and oxygen to effectively oxidize the phosphorus. Thus, the amount of unreacted (undisposed) phosphorus after a blast is reduced.

In addition, in this embodiment, the white phosphorus smoke projectiles or red phosphorus smoke projectiles are blasted in a state that the liquid W is placed at a position spaced apart from the smoke projectiles within the blast-proof container 10. Thus, the effective oxidation of phosphorus and the recovery of fine particles of toxic phosphorus oxide are both achieved. Specifically, if phosphorus comes into contact with water before being oxidized, the phosphorus is inhibited from oxidation, whereby resulting in an increased amount of unreacted phosphorus contained in the liquid W recovered from the inside of the blast-proof container 10 after the blast. In contrast, in this embodiment, the liquid W is placed at the position spaced apart from the white phosphorus smoke projectiles or red phosphorus smoke projectiles, phosphorus and oxygen come into contact at the time of a blast to effectively produce phosphorus oxide, and thereafter, fine particles of the phosphorus oxide are dissolved into the water produced through the condensation of water vapor. Thus, the phosphorus is effectively oxidized, and at the same time, the amount of unreacted phosphorus contained in the liquid W, which is recovered from the inside of the blast-proof container 10 after the blast, is reduced.

Additionally, in this embodiment, an aqueous solution which contains the alkaline agent is placed as the liquid W and therefore, the liquid W held in the blast-proof container 10 after the blast treatment of the smoke projectiles 20 has been neutralized. This enables safe recovery of the liquid W.

Second Embodiment

Figure 2:
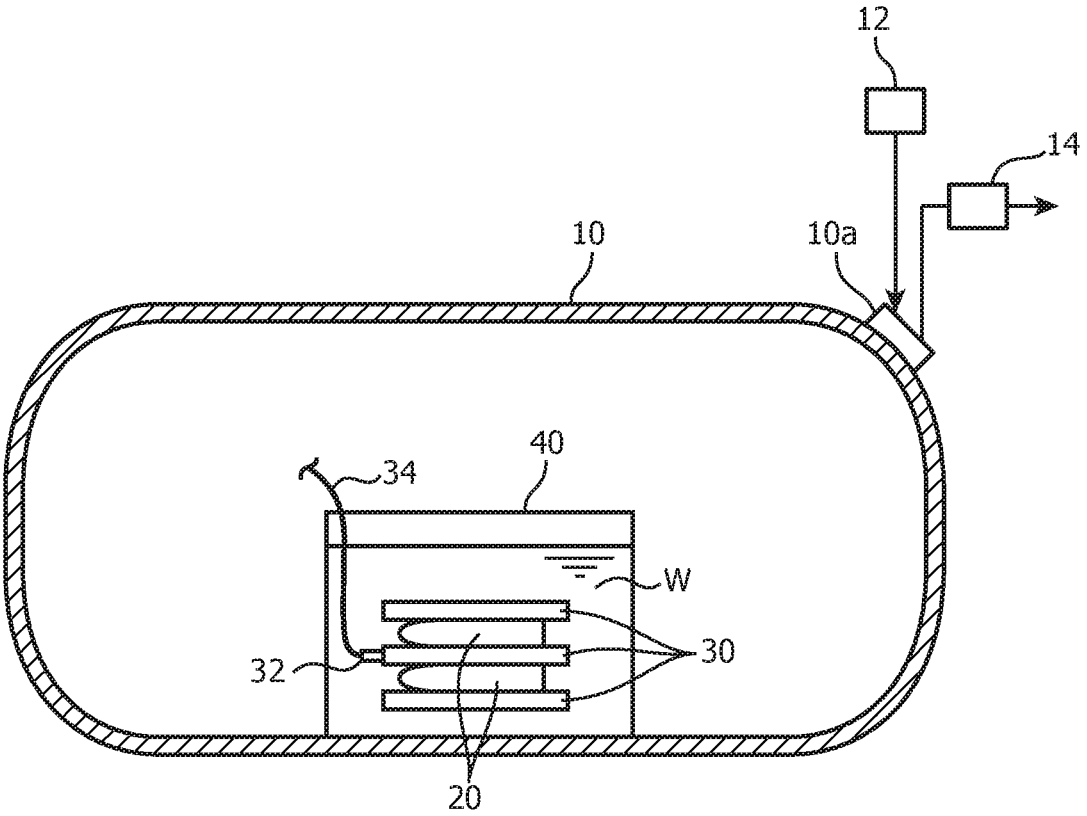
FIG. 2 is a schematic diagram of another blast treatment apparatus for carrying out a blast treatment method according to a second embodiment of the present invention.

In the next place, a blast treatment method of a second embodiment of the present invention will be described with reference to FIG. 2. Incidentally, in the second embodiment, only those different from the first embodiment will be described, and the description of structures, functions and effects identical to those of the first embodiment will be omitted.

In this embodiment, hexachloroethane smoke projectiles (HC smoke projectiles) are subjected to blast treatment as smoke projectiles 20. The smoke projectiles 20 comprise hexachloroethane ($C_2Cl_6$), zinc oxide (ZnO) and aluminum (Al). This embodiment is the same as the first embodiment in that the smoke projectiles 20 each comprise a shell and a burster (hexachloroethane).

Now, the blast treatment method of this embodiment will be described.

In this embodiment, hexachloroethane smoke projectiles and explosives 30 are placed in the container 40 in a state that they are immersed in the liquid W.

Similar to the first embodiment, the followings are carried out in the order as they will appear: drawing of a gas inside the blast-proof container 10 with the suction device 14; supply of oxygen to the inside of the blast-proof container 10 by the supplying device 12; and blasting of the explosives 30 by the igniting detonator 32. In this connection, hexachloroethane smoke projectiles may be subjected to blast treatment in the liquid W, since they do not need oxidation treatment of phosphorus at the time of a blast unlike white phosphorus smoke projectiles or red phosphorus smoke projectiles.

When the explosives 30 are blasted, hexachloroethane reacts as Formula (3) below.

$$C_2Cl_6+2Al \rightarrow 2AlCl_3+2C+\text{heat} \quad (3)$$

By heat produced at this time, zinc oxide vaporizes, and at the same time, a part of hexachloroethane which has not reacted as in Formula (3) decomposes to produce chlorine gas. These zinc oxide and chlorine gas react with each other as shown in Formula (4) below to produce highly deliquescent zinc chloride ($ZnCl_2$).

$$ZnO+Cl_2 \rightarrow ZnCl_2+0.5O_2 \quad (4)$$

This zinc chloride produces white smoke through a reaction with water vapor dispersed due to a detonation occurred at the time of blasting the explosive 30 in the blast-proof container 10. At this time, hydrogen chloride gas and chlorine gas also exist in the blast-proof container 10.

In this embodiment, the amount of water contained in the liquid W held in the container 40 is set at an amount which is capable of precipitating the white smoke produced at the time of blasting hexachloroethane, and at the same time, capable of dissolving hydrogen chloride gas produced at the time of the blast. At the time of blasting the smoke projectiles 20, zinc chloride gas and hydrogen chloride gas are both produced. Here, the solubility of hydrogen chloride gas is smaller than that of zinc chloride. Therefore, it is preferred that the amount of water is set at a value calculated from an assumption that hexachloroethane is converted in its entirety into hydrogen chloride gas, specifically from an assumption that 1 mol of hexachloroethane is converted into 6 mol of hydrogen chloride. When three shots of 75 mm HC smoke projectiles (M88 smoke projectiles) are simultaneously subjected to blast treatment, the amount of hexachloroethane contained in these smoke projectiles is about 8.6 kg. Therefore, provided that this is converted in its entirety into hydrogen chloride, the hydrogen chloride will be 7.9 kg. The amount of water capable of dissolving 7.9 kg of this hydrogen chloride gas is 19.9 L at 100° C. The amount of sodium carbonate that is necessary to neutralize 7.9 kg hydrogen chloride gas is 11.5 kg. In order to dissolve the sodium carbonate into water of 20° C., 53 kg of water is required. In other words, when three shots of 75 mm HC smoke projectiles (M88 smoke projectiles) are simultaneously subjected to blast treatment, the amount of water necessary to dissolve hydrogen chloride gas and sodium carbonate is about 65 L.

Since the amount of water is set as set forth above, the white smoke and hydrogen chloride gas produced at the time of blasting the hexachloroethane smoke projectile are dissolved into the water produced through the condensation of water vapor in the blast-proof container 10. Then, the liquid with the white smoke and hydrogen chloride gas captured therein accumulates on the bottom of the blast-proof container 10. In other words, in the present embodiment, fine powder of zinc chloride and hydrogen chloride gas produced at the time of blasting the hexachloroethane are allowed to settle stationary in water.

As described above, this embodiment also reduces the amount of toxic gas and fine particles in the blast-proof container 10 after the blast treatment of smoke projectiles 20.

Further, in this embodiment, the hexachloroethane smoke projectiles are blasted in the liquid W. Therefore, an blasting energy produced at the time of blasting the hexachloroethane smoke projectiles is absorbed into the liquid W, and as a result, an impact given by the blasting energy to the inside of blast-proof container 10 is alleviated. Thus, damage to the blast-proof container 10 is suppressed. Besides, since the liquid W exists close to the hexachloroethane, the absorption of chlorine-based substances produced at the time of decomposition of the hexachloroethane is facilitated.

It is to be understood that the embodiments described above are only exemplary in all respects, and are not limitations. The scope of the present invention is shown not by the descriptions of the embodiments, but by the scope of the claims, and embraces meanings equivalent to the scope of the claims and any modifications within the scope.

For example, the above embodiment showed the illustrative blasting of the hexachloroethane smoke projectiles in the liquid W, but the hexachloroethane smoke projectiles may be blasted at a position spaced apart from the liquid W as in the first embodiment. However, the blasting of the hexachloroethane smoke projectiles in the liquid W has possibility of protecting the blast-proof container 10 from damage and hence increasing the absorption rate of decomposed substances.

EXAMPLES

In the next place, examples of the blast treatment methods according to the respective embodiments will be described. Hereinbelow, Example 1 of the first embodiment and Example 2 of the second embodiment will be described in this order.

Example 1

Using a blast-proof container 10 with a volume of 5 L, and another blast-proof container 10 with a volume of 20 L, blast treatment was carried out with respect to both of white phosphorus and red phosphorus. FIG. 3 shows results thereof. WP-1 to WP-4 are results on white phosphorus, and RP-1 and RP-2 are results on red phosphorus. In the examples WP-1, WP-3 and RP-1, the blast treatment was carried out without the liquid W placed in the blast-proof container 10. In the examples WP-2, WP-4 and RP-2, the blast treatment was carried out with the liquid W placed in the blast-proof container 10. In the example WP-2, the blast treatment was carried out in a state that water and an agent (neutralizer) were each separately placed in the blast-proof container 10 without having been mixed together. In this example, sodium carbonate was used as the agent. Besides, in this example, after blasting smoke projectiles 20, air was supplied into the blast-proof container 10 after drawing off gas (detonation product gas) that existed in the blast-proof container 10. Then, after supplying 1,000 g of water into the blast-proof container 10, the amount of each component contained in a liquid recovered from the inside of the blast-proof container 10 was measured. In addition, the detonation product gas drawn out from the inside of the blast-proof container 10 was passed through water, and the amount of each component contained in the water was also measured. These measurements was carried out by the quantitative analysis of ions. The numerical values shown in FIG. 3 are the sums of these measured values. It is to be noted that "T-" in FIG. 3 is an abbreviation for "Total" and means the total amount. It is also to be noted that the symbol "<" indicates a value smaller than a value in a column where the symbol is marked. The water supplied in a small amount prior to the blasting in the examples WP-1 and WP-3 was water for water-sealing white phosphorus (to prevent ignition of white phosphorus).

From all of the examples in FIG. 3, it was confirmed that the move of the phosphorus component to the detonation product gas was small in amount, in other words, that the phosphorus component was recovered along with water in the blast-proof container 10.

In the examples where the agent (neutralizer) was placed (WP-2, WP-4 and RP-2), it was confirmed that the pH of the recovered liquid had a value closer to neutrality as compared with the examples without the agent (WP-1, WP-3 and RP-1). It is to be noted that, in the examples without the agent (neutralizer) (WP-1, WP-3 and RP-1), the pH values were relatively small because the detonation product gas contained NOx components.

In the example WP-4 in which the blast was carried out in the state that the liquid W with the agent (neutralizer) dissolved in water was placed, the value of unreacted phosphorus became smaller as compared with the example WP-2 where the blast was carried out in the state that water and the agent were placed apart from each other.

Example 2

Using a blast-proof container 10 with a volume of 5 L, and another blast-proof container 10 with a volume of 20 L, blast treatment was carried out with respect to hexachloroethane smoke projectiles. FIG. 4 shows results thereof. In examples HC-1 and HC-3, the blast treatment was carried out without the liquid W placed in the blast-proof container 10. In the example HC-4, the blast treatment was carried out with the liquid W placed in the blast-proof container 10. In the example HC-2, the blast treatment was carried out with only an agent (sodium carbonate) placed in the blast-proof container 10 prior to the blast. The amount of each component was measured in the same manner as in Example 1.

From all of the examples in FIG. 4, it was confirmed that the move of chlorine-based component to the detonation product gas was small in amount, namely, the chlorine-based component was recovered along with water in the blast-proof container 10 when sufficient oxygen existed in blast-proof container 10 at the time of the blast.

In the examples with the agent (neutralizer) placed (HC-2 and HC-4), the pH of the recovered liquid had a value closer to neutrality (hydrogen ions resulting from hydrogen chloride deceased) as compared with the examples without the agent (HC-1 and HC-3).

In the examples with the agent (HC-2 and HC-4), the recovery rate of zinc (total amount of zinc ions) and the recovery rate of chlorine (total amount of chloride ions) became smaller, as compared to the examples without the agent (HC-1 and HC-3). This is not because of decreases in the recovered amounts of zinc and chlorine, but because of the recovery of zinc and chlorine in the forms that they existed as solid compounds (salts) in water.

Here, the above embodiments will be outlined.

The blast treatment method according to one aspect of the present invention is a blast treatment method in which a smoke projectile, which emits smoke at the time of a blast, is subjected to blast treatment in a blast-proof container, the method comprising a blast step to subject the smoke projectile to blast treatment in the blast-proof container, and a dissolution step to dissolve a gas and fine particles, which are produced when the smoke projectile is blasted, into a liquid containing water in an amount larger than an amount of water produced due to the blast of the smoke projectile in the blast-proof container.

In the present blast treatment method, the toxic gas and fine particles produced at the time of the blasting of the smoke projectile are dissolved into (allowed to settle stationary in) the liquid containing water in the amount larger than the amount of water produced due to the blasting of the smoke projectile in the blast-proof container. As a result, the load on the suction device, which draws out the gas and fine particles from the inside of the blast-proof container after the blast treatment, is reduced. It is to be noted that water produced due to the blast also contributes to the capture of the gas and fine particles. The method also inhibits leakage of the gas and fine particles to the outside when the inside of the blast-proof container is opened to the outside of the blast-proof container after the blast treatment. For example, although hydrogen chloride gas is produced at the time of the blast of the hexachloroethane smoke projectiles, the hydrogen chloride gas is recovered by dissolving it into the liquid. When the white phosphorus smoke projectiles or red phosphorus smoke projectiles are blasted, fine particles of phosphorus oxide disperse in the blast-proof container but these fine particles are recovered through their dissolution in the liquid.

In this case, it is preferred to dissolve the gas and fine particles into the liquid in the amount capable of dissolving the gas and fine particles in the entirety thereof in the dissolution step.

In this manner, substantially the whole amount of the gas and fine particles are dissolved in the liquid in the dissolution step, so that the recovery efficiency of the gas and fine particles is improved.

It is also preferred that the blast treatment method further comprises a liquid placement step to place the liquid, which comprises the water, in the blast-proof container prior to the blast step; that in the blast step, the smoke projectile is blasted and the water is vaporized; and that in the dissolution step, the gas and fine particles are dissolved into the water produced through the condensation of water vapor when the water vapor produced in the blast step condenses as temperature lowers.

In this manner, the inside of the blast-proof container is filled with the water vapor produced through the evaporation of the water from the liquid W due to a detonation occurred at the time of the blast, and, when the water vapor condenses as temperature lowers after the detonation, the gas and fine particles are dissolved into (captured by) the water produced through the condensation of the water vapor. Thus, the recovery efficiency of the gas and fine particles is improved as compared with a case where the liquid is supplied into the blast-proof container after the blast step to thereby dissolve the gas and fine particles into the liquid in the blast-proof container.

Specifically, in the blast step, a white phosphorus smoke projectile or a red phosphorus smoke projectile is blasted as the smoke projectile, and the blast step may be carried out in a state that oxygen in an amount capable of oxidizing the whole phosphorus contained in the white phosphorus smoke projectile or red phosphorus smoke projectile exists in the blast-proof container.

In this manner, the phosphorus contained in the smoke projectile is effectively oxidized (disposed of) as the white phosphorus smoke projectile or red phosphorus smoke projectile is blasted. Specifically, the phosphorus contained in the white phosphorus smoke projectile or red phosphorus smoke projectile is micronized at the time of the blast, resulting in the provision of an increased surface area to the phosphorus, resulting in an increased probability of collisions (a reaction) between phosphorus and oxygen, and as a result, the phosphorus is effectively oxidized. Thus, the amount of unreacted (undisposed) phosphorus after the blast step is reduced.

In this case, in the liquid placement step, the liquid may preferably be placed at a position spaced apart from the white phosphorus smoke projectile or red phosphorus smoke projectile within the blast-proof container.

In this manner, it is possible to achieve both of the effective oxidation of phosphorus and the recovery of the fine particles of toxic phosphorus oxide. Specifically, if phosphorus comes into contact with water before being oxidized, phosphorus is inhibited from oxidation, whereby resulting in an increased amount of unreacted phosphorus contained in the liquid recovered from the inside of the blast-proof container after the blast treatment. In contrast, in the present method, since the liquid is placed at the position spaced apart from the white phosphorus smoke projectile or red phosphorus smoke projectile, phosphorus and oxygen come into contact in the blast step to thereby effectively produce phosphorus oxide, and thereafter, fine particles of the phosphorus oxide are dissolved in the water in the dissolution step. Thus, phosphorus is effectively oxidized, and at the same time, the amount of unreacted phosphorus contained in the liquid recovered from the inside of the blast-proof container after the blast step is reduced.

In the present blast treatment method, a hexachloroethane smoke projectile may also be blasted as the smoke projectile in the liquid in the blast step.

In this manner, blasting energy produced at the time of blasting of the hexachloroethane smoke projectile is absorbed in the liquid, so that an impact which is given by the blasting energy to the inside of the blast-proof container is alleviated. Thus, damage to the blast-proof container is suppressed.

In this case, the blast step may preferably be carried out with oxygen existing in the blast-proof container.

In this manner, the oxidation of carbon monoxide generated at the time of blasting of the hexachloroethane smoke projectile is promoted, leading to a reduction in the toxicity of gas that exists in the blast-proof container after the blast treatment.

Besides, in the present blast treatment method, it is preferred that in the dissolution step, the gas and fine particles are dissolved into an aqueous solution as the liquid, the aqueous solution comprising the water and alkaline agent dissolved in the water.

In this manner, the liquid in the blast-proof container after the blast treatment of the smoke projectile is neutralized to allow safe recovery of the liquid.

The invention claimed is:

1. A blast treatment method for carrying out blast treatment of a smoke projectile that emits smoke at a time of a blast in a blast-proof container, which comprises:

a liquid placement step to place the liquid, which comprises the water, in the blast-proof container, a blast step to blast the smoke projectile in the blast-proof container, a dissolution step to dissolve, in the blast-proof container, a gas and fine particles, which are produced when the smoke projectile is blasted, into a liquid that comprises water in an amount larger than an amount of water produced due to the blast of the smoke projectile wherein:

in the blast step, the smoke projectile is blasted and the water is vaporized and in the dissolution step, the gas and fine particles are dissolved into water produced through condensation of water vapor when the water vapor produced in the blast step condenses as temperature lowers.

2. The blast treatment method according to claim 1, wherein:

the gas and fine particles are dissolved into the liquid in an amount capable of dissolving of the gas and fine particles in an entirety thereof in the dissolution step.

3. The blast treatment method according to claim 1, wherein:

in the blast step, a white phosphorus smoke projectile or a red phosphorus smoke projectile is blasted as the smoke projectile; and the blast step is carried out in a state that in the blast-proof container, oxygen exists in an amount capable of oxidizing whole phosphorus contained in the white phosphorus smoke projectile or the red phosphorus smoke projectile.

4. The blast treatment method according to claim 3, wherein:

in the liquid placement step, the liquid is placed at a position spaced apart from the white phosphorus smoke projectile or the red phosphorus smoke projectile within the blast-proof container.

5. The blast treatment method according to claim 1, wherein:

in the blast step, a hexachloroethane smoke projectile is blasted as the smoke projectile in the liquid.

6. The blast treatment method according to claim 5, wherein:

the blast step is carried out with oxygen existing in the blast-proof container.

7. The blast treatment method according to claim 1, wherein:

in the dissolution step, the gas or the fine particles are dissolved into an aqueous solution as the liquid, the aqueous solution comprising the water and an alkaline agent dissolved in the water.

* * * * *